United States Patent [19]

Compton

[11] 4,181,177

[45] Jan. 1, 1980

[54] CONTROLLING SHALE OIL POUR POINT

[75] Inventor: Leslie E. Compton, Claremont, Calif.

[73] Assignee: Occidental Research Corporation, Irvine, Calif.

[21] Appl. No.: 878,668

[22] Filed: Feb. 17, 1978

[51] Int. Cl.[2] ..... E21B 43/24; E21C 41/10

[52] U.S. Cl. ..... 166/256; 137/4; 166/259; 166/267; 208/14; 585/12; 299/2

[58] Field of Search ..... 166/256, 259, 265, 266, 166/267, 272; 137/2, 3, 4; 208/11 R, 14, 19, 370; 252/8.3, 8.55, 59 B; 299/2

[56] References Cited

U.S. PATENT DOCUMENTS

| | | | |
|---|---|---|---|
| 3,034,979 | 5/1962 | Nevens | 166/256 |
| 3,284,336 | 11/1966 | Culbertson, Jr. et al. | 208/14 X |
| 3,453,205 | 7/1969 | Francis, Jr. et al. | 137/3 X |
| 3,523,071 | 8/1970 | Knapp et al. | 208/14 |
| 3,527,692 | 9/1970 | Titus | 208/370 X |
| 3,532,618 | 10/1970 | Wunderlich et al. | 208/14 |
| 3,548,938 | 12/1970 | Parker | 166/256 |
| 3,738,931 | 6/1973 | Frankovich et al. | 208/58 X |
| 4,014,575 | 3/1977 | French et al. | 166/256 X |

FOREIGN PATENT DOCUMENTS

76/2737 5/1976 South Africa .

OTHER PUBLICATIONS

Lorensen, L. E., "Pour Point Depression I: Mechanism Studies", Symposium on Polymers in Lubricating Oil, American Chemical Society, Sep. 9-14, 1962, pp. B-61 to B-69.

Holder, G. A. et al., "Wax Crystallization from Distillate Fuels", Journal of the Institute of Petroleum, vol. 51, Jul. 1965, pp. 228-252.

Knepper, J. I. et al., "Blend for Lower Pour Point", Hydrocarbon Processing, Sep. 1975, pp. 129-136.

*Primary Examiner*—Stephen J. Novosad
*Assistant Examiner*—George A. Suchfield
*Attorney, Agent, or Firm*—Christie, Parker & Hale

[57] ABSTRACT

A crude shale oil is produced by in situ retorting of oil shale in a fragmented permeable mass of formation particles containing oil shale in an in situ oil shale retort in a subterranean formation containing oil shale. A combustion zone is advanced through the fragmented mass by introducing an oxygen containing gas to the mass on the trailing side of the combustion zone and withdrawing an off gas from the fragmented mass on the advancing side of the combustion zone. Gas flow advances the combustion zone through the fragmented mass and transfers heat of combustion to a retorting zone on the advancing side of the combustion zone. Kerogen in oil shale in the retorting zone is decomposed to produce gaseous and liquid products including crude shale oil. Crude shale oil produced by such a process and having characteristics described herein is withdrawn from the fragmented mass on the advancing side of the retorting zone. A fraction, such as a low boiling fraction, a paraffin fraction, or a high boiling, paraffin rich fraction, is separated from a first portion of such crude shale oil to produce a modified shale oil having a pour point different from the pour point of the crude shale oil. The separated fraction is mixed with a second portion of shale oil to produce a blended shale oil having a pour point different from the pour point of the second portion of shale oil.

40 Claims, 3 Drawing Figures

CONTROLLING SHALE OIL POUR POINT

BACKGROUND OF THE INVENTION

The presence of large deposits of oil shale in the Rocky Mountain region of the United States has given rise to extensive efforts to develop methods for recovering shale oil from kerogen in formations containing oil shale. It should be noted that the term "oil shale" as used in the industry is in fact a misnomer; it is neither shale nor does it contain oil. It is a sedimentary formation comprising marlstone deposit with layers containing an organic polymer called "kerogen" which upon heating thermally decomposes to produce hydrocarbonaceous liquid and gaseous products. It is the formation containing kerogen that is called "oil shale" herein, and the liquid hydrocarbonaceous product is called "shale oil". "Crude shale oil" is a term used herein for shale oil withdrawn from a fragmented permeable mass of formation particles in an in situ oil shale retort without further processing, except such processing as may be required for separating crude shale oil and water. Such processing can include heating of the crude shale oil and water, such as emulsion of crude shale oil and water, to about 150° F. or more and/or addition of minor amounts of emulsion breaking materials. The pour point of crude shale oil is measured after separation of water from such crude shale oil.

A number of methods have been proposed for processing oil shale which involve either first mining the kerogen bearing shale and processing the shale above ground, or processing the shale in situ. The latter approach is preferable from the standpoint of environmental impact since the spent shale remains in place, reducing the chance of surface contamination and the requirement for disposal of solid waste.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by this reference. The patent describes in situ recovery of liquid and gaseous hydrocarbon materials from a subterranean formation containing oil shale by mining out a portion of the subterranean formation and then explosively fragmenting and expanding a portion of the remaining formation to form a fragmented, permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of a combustion zone feed containing oxygen into the combustion zone to advance the combustion zone through the retort. The combustion zone feed can contain steam provided by a steam generator to improve efficiency of retorting. In the combustion zone, oxygen in the combustion zone feed is depleted by reaction with hot carbonaceous materials to produce heat and combustion gas. By the continued introduction of the oxygen supplying combustion zone feed into the combustion zone, the combustion zone is advanced through the retort.

The effluent gas from the combustion zone comprises combustion gas and any gaseous portion of the combustion zone feed that does not take part in the combustion process. This effluent gas passes through the retort on the advancing side of the combustion zone to heat the oil shale in a retorting zone to a temperature sufficient to produce kerogen decomposition, called retorting, in the oil shale to gaseous and liquid hydrocarbonaceous products and a residue of solid carbonaceous material.

The liquid products and gaseous products are cooled by cooler oil shale fragments in the retort on the advancing side of the retorting zone. An off gas containing combustion gas generated in the combustion zone, gaseous product produced in the retorting zone, gas from carbonate decomposition, and any gaseous combustion zone feed that does not take part in the combustion process is withdrawn to the surface. Liquid hydrocarbon products, together with water produced in or added to the retort, are also withdrawn to the surface as a liquid product stream through an access tunnel, drift or shaft. The liquid hydrocarbon products are separated from the water in the liquid product stream to produce crude shale oil.

The properties of shale oil vary appreciably with the technique used for producing the shale oil. The length of time during which an in situ retort has been in operation has a marked effect on the pour point, on the paraffin content and on the nature and molecular weight distribution of the paraffin content, of the shale oil withdrawn from the retort. The pour point of the oil tends to rise gradually during the retorting period, and oil produced toward the end of the retorting period of an in situ oil shale retort can have an undesirably high pour point. Earlier in the retorting period, the pour point can be lower than necessary for movement through a pipeline. Properties of shale oil are also much different from those of petroleum. Consequently, techniques and additives developed for controlling the pour point of crude petroleum are not necessarily effective for controlling the pour point of crude shale oil.

Crude shale oil tends to thicken when cooled and progressively becomes increasingly resistant to flow in fluid handling operations such as pumping through a pipeline. However, there is little or no relation between the viscosity and the pour point of a particular oil. The temperature at which the oil changes from a flowable to a non-flowable state, as measured by ASTM D 97, is called the pour point. At temperatures from slightly above the pour point to below the pour point, the oil can be difficult or impossible to pump, requiring the use of costly heated pipelines, tank cars, and the like. The transportation of such oil is thus hindered, particularly in colder months when the need for the oil can be great. Because shale oil is produced from oil shale deposits located far from population centers and refining facilities in areas of the western United States subject to severe winters, practical methods for regulating the pour point of shale oil are needed.

The pour point of shale oil must be low enough to allow the oil to be pumped through pipelines. Higher pour points are acceptable in warmer climates or warmer months of the year, and conversely lower pour points are required when cooler temperatures prevail. It is considered that, in the Piceance Creek Basin of western Colorado during the winter months, shale oil having a pour point lower than about 20° F. can generally be pumped satisfactorily, even though prevailing temperatures can be much below 20° F. This is because the shale oil is warm, e.g., above about 100° F., when it is withdrawn from an in situ shale retort. The warm oil can be pumped, and once it is flowing it can continue to flow when its temperature drops below its pour point. However, if the flow of oil is interrupted, it can set up to an unpumpable state if cooled below its pour point, and warming can be required before pumping can be resumed.

It would be desirable to have shale oil produced by in situ retorting which consistently has an advantageously low pour point and to have a method for regulating the pour point of shale oil produced by in situ retorting.

SUMMARY OF THE INVENTION

Thus, in practice of this invention, there is provided a blended shale oil composition comprising (a) crude shale oil, preferably crude shale oil produced by in situ retorting of oil shale in an in situ oil shale retort by advancing a combustion zone through a fragmented permeable mass of particles containing oil shale in such an in situ oil shale retort, and (b) a fraction obtained from crude shale oil, preferably shale oil produced by in situ retorting. The fraction can be a low boiling fraction, a paraffinic fraction, or a high boiling fraction having a relatively higher paraffin content than the overall paraffin content of the shale oil.

Crude shale oil is produced in an in situ oil shale retort by advancing a combustion zone through such a fragmented mass. An oxygen-containing gas is introduced into the fragmented mass on a trailing side of the combustion zone, and an off gas is withdrawn from the fragmented mass on the advancing side of the combustion zone. Flow of gas advances the combustion zone through the fragmented mass and transfers heat of combustion to a retorting zone in the fragmented mass on the advancing side of the combustion zone. Kerogen in oil shale in the retorting zone is decomposed to produce gaseous and liquid hydrocarbonaceous products and crude shale oil is withdrawn from the fragmented mass. A fraction is separated from a portion of such crude shale oil to change the pour point of the crude shale oil, and at least a portion of such separated fraction is added to another portion of crude shale oil to change the pour point thereof.

In an embodiment of the invention, a low boiling fraction is separated from a first portion of crude shale oil from such an in situ oil shale retort, raising the pour point of the shale oil. At least a portion of such low boiling fraction is then added to a second portion of crude shale oil from such an in situ oil shale retort to produce a blended shale oil having a lower pour point than the pour point of the second portion of crude shale oil.

In another embodiment, a paraffinic fraction is removed from a first portion of crude shale oil from such an in situ oil shale retort to lower the pour point of the crude shale oil. At least a portion of such paraffinic fraction is then added to a second portion of crude shale oil from such an in situ oil shale retort to produce a blended shale oil having a higher pour point than the second portion of shale oil.

In another embodiment, a high boiling fraction is separated from a first portion of crude shale oil from an in situ oil shale retort, lowering the pour point of the shale oil. At least a portion of such a high boiling fraction is blended with a second portion of crude shale oil from an in situ oil shale retort to produce a blended shale oil having a higher pour point than the second portion of crude shale oil.

DRAWINGS

DETAILED DESCRIPTION

Briefly, this invention concerns modifying the pour point of crude shale oil to facilitate its transportation and processing. When the crude shale oil has a pour point too high for convenient handling under prevailing temperatures, a fraction is separated from the oil to lower its pour point. To avoid the need for separate transportation of the separated fraction, it can be added to crude shale oil having a lower pour point than necessary for convenient handling to produce a blended shale oil having a higher pour point that is still within the range for convenient handling.

Alternatively, when crude shale oil has a pour point lower than needed for convenient handling under prevailing conditions, a fraction is separated from such shale oil to raise the pour point, but not above the pour point required for convenient handling. The separated fraction is then added to crude shale oil that has a pour point too high for convenient handling to produce a blended shale oil having a lower pour point within the range for convenient handling.

Thus, the primary object of the invention is to lower the pour point of crude shale oil having a pour point too high for convenient handling under prevailing temperatures. This object is accomplished by separating a fraction from such crude shale oil or by adding to such crude shale oil a fraction separated from other such crude shale oil.

Another object of the invention is to provide a method for conveniently transporting a fraction that has been separated from crude shale oil to lower the pour point of the crude shale oil. This object is accomplished by adding such fraction to crude shale oil having a lower pour point than needed for convenient handling to raise the pour point of the crude shale oil without raising the pour point too high.

Figure 1:
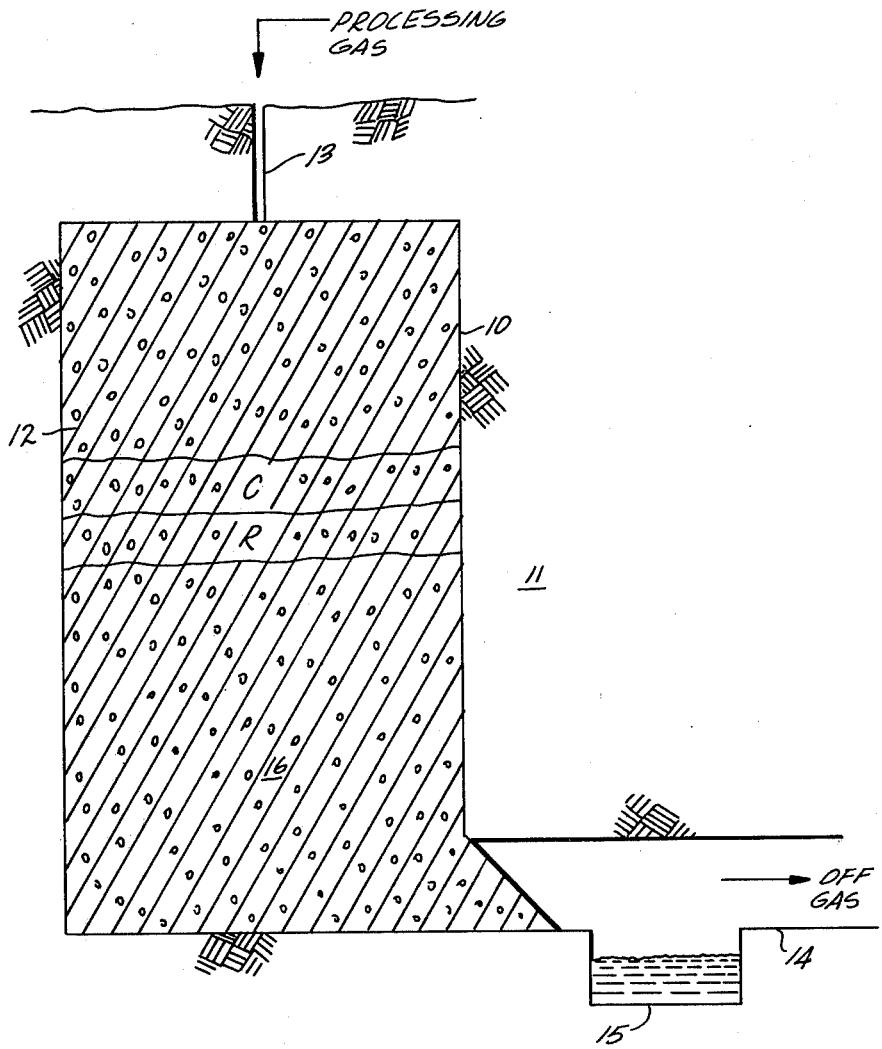
FIG. 1 illustrates schematically in vertical cross-section an in situ oil shale retort for producing shale oil.

FIG. 1 illustrates schematically in vertical cross-section an in situ oil shale retort 10 in a subterranean formation 11 containing oil shale, the retort being in an intermediate stage of retorting with a retorting zone R in a mid-portion of the retort. The in situ oil shale retort contains a fragmented permeable mass 16 of formation particles containing oil shale in a cavity 12.

The fragmented mass can have a wide distribution of particle sizes. For example, an in situ oil shale retort in the Piceance Creek Basin of Colorado prepared by explosive expansion of formation toward a void contains a fragmented permeable mass comprising about 58% by weight particles having a weight average diameter of about 2 inches, about 23% by weight particles having a weight average diameter of about 8 inches, and about 19% by weight particles having a weight average diameter of about 30 inches.

Each cavity 12 can be created simultaneously with fragmentation of the mass 16 of formation particles contained therein by blasting by any of a variety of techniques. A desirable technique involves excavating a void within the in situ oil shale retort site and explosively expanding remaining oil shale in the site toward the void. Such a method of forming an in situ oil retort is described in above-mentioned U.S. Pat. No. 3,661,423. Methods of forming an in situ oil shale retort are also described in U.S. Pat. Nos. 4,043,595 to French; 4,043,596 to Ridley; 4,043,597 to French; and 4,043,598 to French and Garrett, which are assigned to the assignee of the present application and are incorporated herein by this reference. A variety of other techniques can also be used.

The total volume of the excavated void or voids is less than about 30% of the total volume of the retort being formed, preferably in the range of about 10 to 25 percent. When formation is fragmented, the excavated void volume becomes distributed throughout the resulting fragmented mass, providing a fragmented mass of high permeability and low resistance to gas flow.

Crude shale oil which can be treated in accordance with this invention can be produced by processes described in the above-mentioned patents. The operation of an in situ oil shale retort and the nature of the products obtained therefrom are described in U.S. patent application Ser. No. 765,053, now abandoned filed Feb. 2, 1977, by Chang Yul Cha and Richard D. Ridley, and assigned to the assignee of the present application. The entire disclosure of said U.S. patent application Ser. No. 765,053 is incorporated herein by this reference.

One or more gas conduits 13 are provided in communication with an upper portion of the fragmented mass of particles containing oil shale in the in situ retort. During retorting operations air or other oxygen-containing gas is introduced to an upper portion of the fragmented mass to supply oxygen for combustion. The air can be enriched with oxygen, or can be diluted with off gas recycled from an in situ oil shale retort or with other combustible or inert gas so that the oxygen concentration in the processing gas introduced into the fragmented mass is lower than the oxygen concentration of the air.

Preferably, the gas introduced to the fragmented permeable mass comprises air diluted with recycled off gas or with water vapor from a steam generator so that the oxygen concentration is less than about 15% by volume. Higher concentrations of oxygen can be employed in some grades of oil shale.

A drift 14 or the like is in fluid communication with a lower portion of the fragmented permeable mass in the in situ retort. In the embodiment illustrated schematically in FIG. 1 the drift contains a sump 15 in which liquid products of retorting, including crude shale oil withdrawn from the fragmented mass, are collected. Both crude shale oil and water are withdrawn from the sump and can be processed as required for separation of the crude shale oil and water. Off gas is also withdrawn from a lower portion of the fragmented mass in the in situ oil shale retort by way of the drift 14. Such off gas includes gaseous products of retorting.

At the start of the retorting operation a portion of the fragmented permeable mass at a location in an upper portion of the in situ oil shale retort is ignited for establishing a combustion zone in the fragmented mass. A variety of techniques are available for igniting an upper portion of the fragmented mass and establishing a satisfactory combustion zone in the retort. Thus, for example, shale oil, liquefied petroleum gas (LPG), or other fuel can be burned adjacent one or more gas inlet conduits 13 for heating oil shale in the fragmented mass to an ignition temperature. After a combustion zone is established in the fragmented mass, introduction of fuel can be terminated, or if desired, a secondary combustion zone can be maintained in the fragmented mass in accordance with the process described in U.S. patent application Ser. No. 844,035, now abandoned, filed Oct. 20, 1977, by Chang Yul Cha and assigned to the assignee of the present application, the entire disclosure of which is incorporated herein by this reference.

Gas flow through the combustion zone C causes the combustion zone to advance downwardly through the fragmented mass as carbonaceous material in the oil shale is burned in the combustion zone. Heat of combustion is transferred from the combustion zone downwardly by flowing gas to establish and advance a retorting zone R on the advancing side of the combustion zone. The heat of combustion raises the temperature of particles containing oil shale in the retorting zone to a retorting temperature such as about 900° F. or higher. Kerogen in oil shale in the retorting zone is decomposed to produce hydrocarbonaceous gaseous and liquid products including crude shale oil.

Particles in the fragmented mass on the advancing side of the combustion zone are heated by the sensible heat of flowing gas, condensation of water vapor, and condensation of hydrocarbon materials. Such heat transfer on the advancing side of the retorting zone produces a substantial zone within which the fragmented mass is preheated to an elevated temperature. This results in slow heating of oil shale from ambient temperatures to about 900° F. Preferably, heating of oil shale from a temperature of about the boiling point of water to about 900° F. is at a rate less than about 10° F. per hour. Heating rate at lower temperatures appears of less significance because of minimal changes in oil shale or kerogen at lower temperatures. Retorting of oil shale by slow heating to about 900° F. results in a valuable crude shale oil product having unique properties.

Hydrocarbons produced by decomposition of kerogen in the retorting zone advance through a zone of elevated temperature in the fragmented mass on the advancing side of the retorting zone. In the portion of the fragmented mass on the advancing side of the retorting zone, the liquid or liquefiable hydrocarbons are subjected to conditions that can affect the properties of the hydrocarbons before reaching the end of the fragmented mass.

At least a portion of the fragmented mass is at an elevated temperataure and hydrocarbons are similarly exposed to elevated temperature. As an indication of the temperature adjacent gas flow paths in an in situ oil shale retort retorted according to processes as described above, the temperature of off gas withdrawn from an in situ oil shale retort can exceed 100° F. a short time (e.g., ten days to two weeks) after a combustion zone is established. In one exemplary retort, off gas temperature gradually rose to about 150° F. Temperature measurements by way of thermocouples near the bottom of the fragmented mass in the in situ oil shale retort indicated temperatures in the order of 120° F. As the retorting zone approached the thermocouples, temperature gradually increases. One such set of measurements indicated an elapsed time of about one month for a temperature increase from about 150° to about 350° F. Further temperature increase to about 900° F. is estimated to require at least three or four days. Heating rate is estimated at less than about 10° F. per hour up to about 900° F.

The rate of advance of the retorting zone through the fragmented mass in the in situ oil shale retort can be slow, e.g., up to about 1.2 feet per day. Consequently, an active in situ oil shale retort can be undergoing retorting for a considerable period of time. For example, a retort about 270 feet high has been retorted over a period of five and one-half months.

Since an operating in situ oil shale retort as provided in practice of this invention is long, for example a few hundred feet long, hydrocarbonaceous liquids percolating through the fragmented permeable mass on the advancing side of the retorting zone have a long residence time in the surface area on particles over which liquid hydrocarbonaceous materials can flow. Thus, the path length through the fragmented mass traversed by hydrocarbonaceous materials between the retorting zone and the location where crude shale oil is withdrawn from the fragmented mass can be quite long.

As retorting continues, the path length through the fragmented mass traversed by hydrocarbons between the retorting zone and the location where crude shale oil is withdrawn progressively decreases and conditions in the fragmented mass on the advancing side of the retorting zone change. One effect of these changes is that the pour point of the crude shale oil withdrawn from the fragmented mass gradually increases. Another is that the paraffin content of the oil gradually increases.

Crude shale oil produced by in situ retorting by processes as hereinabove described can be treated in accordance with the practice of this invention. As an example of practice of such a process an in situ oil shale retort about 120 feet square in horizontal cross section and about 270 feet high was prepared in a southern part of the Piceance Creek Basin region of Colorado. The Room 4 retort contained a fragmented permeable mass of particles of formation containing oil shale from the Piceance Creek Basin. The average Fischer Assay of oil shale in the fragmented mass was less than about 15 gallons per ton.

An upper portion of the fragmented mass in the in situ oil shale retort was ignited by introducing air and LPG and burning the resultant mixture. This raised a substantial portion of the particles in the upper portion of the fragmented mass to an ignition temperature and establishing a combustion zone. Oxygen containing gas was introduced to an upper portion of the fragmented mass in the retort for advancing the combustion zone downwardly through the fragmented mass. Off gas was withdrawn from a lower portion of the fragmented mass and the resultant flow of gas downwardly through the in situ retort carried heat of combustion downwardly from the combustion zone into a retorting zone.

Thermal decomposition of kerogen in oil shale in the retorting zone yielded gaseous and liquid hydrocarbon products. Crude shale oil and water were withdrawn from the bottom of the fragmented mass in the retort. The off gas withdrawn from the bottom of retort included gaseous products.

Such retorting operation was conducted in the Room 4 retort for about five and one-half months, during which time the retorting zone advanced downwardly through more than 200 feet of the fragmented mass in the retort. It is calculated that the average rate of the advancement of the retorting zone in the retort was about 1.2 feet per day.

In the following Table, the pour points of crude shale oil withdrawn from Room 4 at various times during and retorting period are shown.

POUR POINT OF ROOM 4 SHALE OIL

| Date Produced | Pour Point, °F. ± 5° F. |
|---|---|
| 1/22 | −10 |
| 1/29 | −20 |
| 2/10 | −10 |
| 2/19 | −15 |
| 2/26 | −10 |
| 3/4 | −5 |
| 3/11 | 0 |
| 3/18 | 30 |
| 3/26 | 20 |
| 4/1 | 15 |
| 4/8 | 15 |
| 4/15 | 10 |
| 4/22 | 10 |
| 4/29 | 20 |
| 5/6 | 25 |
| 5/13 | 40 |
| 5/20 | 50 |

Three other in situ oil shale retorts have been prepared and retorted by generally similar techniques. These in situ oil shale retorts are identified as Room 1, 2, and 3, respectively. Each of these retorts had a square horizontal cross section of about 1000 square feet. The Room 1 retort had a height of about 72 feet. The Room 2 retort had a height of about 94 feet. The Room 3 retort had a height of about 113 feet. Each of the retorts contained a fragmented permeable mass of particles containing oil shale from the Piceance Creek Basin. Most of the length of the fragmented mass in each retort was retorted by processes as described herein.

Figure 2:
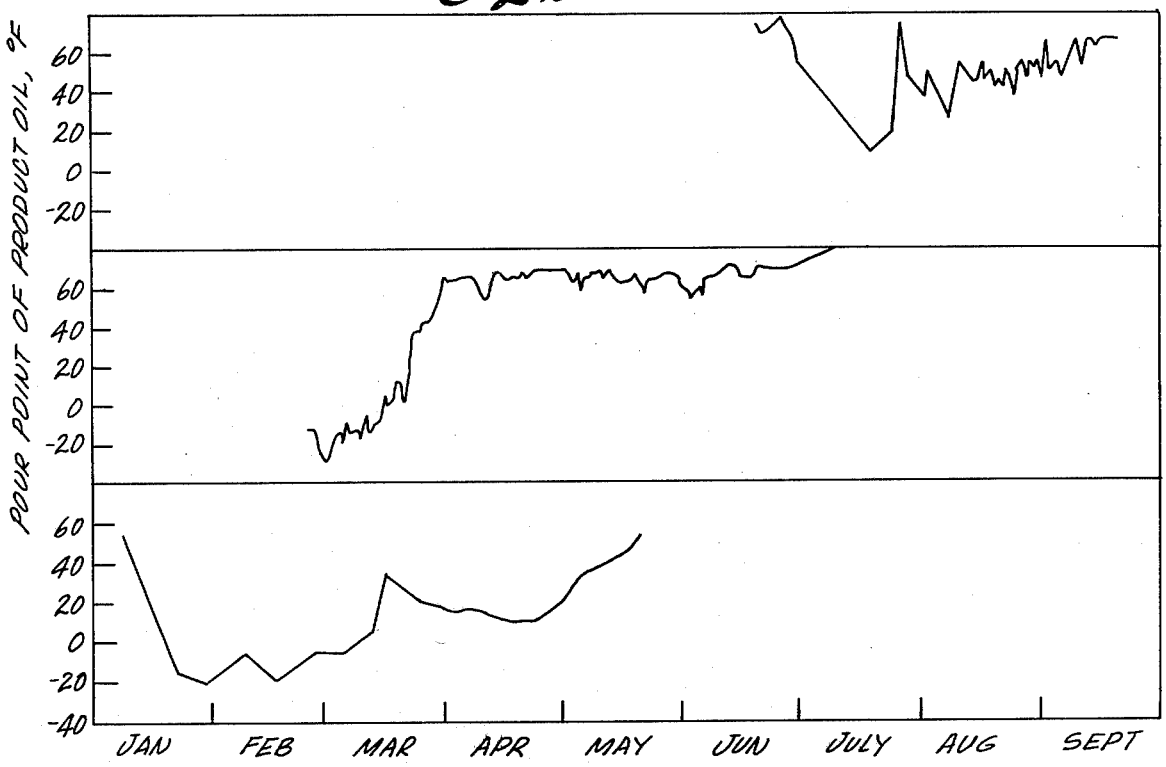
FIG. 2 is a graph of the pour point of crude shale oil withdrawn from in situ oil shale retorts as a function of time of retorting.

Shale oil produced by in situ retorting as described above can have a pour point in the range of about −30 to 70° F. FIG. 2 shows the pour point of crude shale oil withdrawn from Retorts 2, 3, and 4 as a function of time. Pour points were measured according to the procedure of ASTM D97. The generally upward trend of pour point with time of retorting a given retort is clear.

The graphs in FIG. 2 show that during a considerable period of operation of an in situ oil shale retort, the shale oil produced can have a pour point lower than 20° F.

In accordance with practice of this invention, a fraction is separated from one portion of crude shale oil to produce a modified shale oil having a pour point different from the pour point of the first portion of crude shale oil, and such separated fraction is blended with another portion of such crude shale oil to produce a blended shale oil composition having a pour point different from the pour point of the second portion of crude shale oil. The fraction can be a low boiling end fraction, a paraffinic fraction, or a high boiling end fraction of crude shale oil.

The cruce shale oil from which the fraction is separated can be any crude shale oil in which the desired fraction is present, preferably crude shale oil produced by the in situ retorting processes herein described and including mixtures of crude shale oil from a plurality of in situ oil shale retorts. It is preferred to add the separated fraction to other crude shale oil produced by in situ retorting. Nevertheless, the method of this invention can be employed to regulate or adjust the pour points of crude shale oils produced by other processes.

A preferred blended shale oil composition of this invention comprises (a) a first portion of crude shale oil produced by in situ retorting of oil shale in an in situ oil shale retort containing a fragmented permeable mass of formation particles containing oil shale in a subterranean formation containing oil shale by advancing a combustion zone through the fragmented mass by introducing an oxygen containing gas into the fragmented mass on a trailing side of the combustion zone and withdrawing an off gas from the fragmented mass on an advancing of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products and (b) a fraction separated from another portion of such crude shale oil.

In the practice of one embodiment of this invention, a low boiling fraction is separated from crude shale oil. The low boiling fraction contemplated herein comprises the lowest boiling constituents of crude shale oil, and can constitute up to about 25 weight percent of the crude shale oil from which it is separated, exclusive of any dissolved or suspended water in the shale oil or in the separated low boiling fraction. Preferably, the low boiling fraction comprises up to about 15 weight percent of the shale oil from which it is separated. A preferred low boiling fraction, constituting up to about 5 weight of crude shale oil from which it is removed, has a boiling range (ASTM D1160 Corrected) of up to about 500° F. at 1 atmosphere pressure. The separated low boiling fraction is liquid at ambient temperature and pressures. The composition of the low boiling fraction can depend upon the particular shale oil from which it is separated and upon the method employed to achieve the separation.

Any method, such as distillatin at elevated, ambient, or reduced pressure, steam distillation, or fractional distillation, that can separate a low boiling fraction can be employed. It has been noted that the pour point of fresh shale oil produced by in situ retorting as described herein rises when the oil is heated at temperatures approaching 200° C., even under total reflux that prevents loss of light ends. It is therefore apparent that such shale oil is a complex, chemically active system. For this reason, it is preferable to separate the low boiling fraction at as low a temperature as possible, desirably by means of steam distillation under vacuum.

A cut of the low boiling fraction separated from the shale oil can also be used. For example, the very lightest components of the low boiling fraction can be separated from the low boiling fraction for use as fuel to heat shale oil for distillation, and the remainder of the low boiling fraction can be blended with another portion of crude shale oil for modifying the pour point thereof.

As retorting of a particular retort proceeds, the proportion of the low boiling fraction in the crude shale oil product can decline. Therefore, crude shale oil withdrawn early in a retorting period is used preferably as the source of low boiling fraction, because it can contain a higher proportion of low boiling fraction than crude shale oil withdrawn later in a retorting period.

In practice of another embodiment of this invention, the separated fraction can be a paraffinic fraction of crude shale oil. Crude shale oil from in situ shale oil retorts contains about 5 to 20, e.g. about 5 to 15, weight percent of a paraffinic fraction comprising paraffins, primarily n-paraffins, having from about 6 to about 40 or more carbons. The paraffinic fraction contains a major proportion of n-paraffins, i.e., linear, saturated compounds consisting of carbon and hydrogen, and can also contain slightly branched paraffins such as isoparaffins and other paraffins having lower alkyl, i.e., one or two carbon, side groups. The separated paraffinic fraction is a waxy solid at temperatures below about 80° F. The fraction can also contain substantially paraffinic compounds substituted to a minor extent with terminal functional groups such as ester, alcohol, carboxylic acid, cycloaliphatic and aromatic end groups. The composition of the paraffinic fraction depends upon the particular shale oil from which it is separated and upon the method used to obtain the fraction from about 1 to 15 weight percent of a first portion of crude shale oil.

Paraffinic fraction can be removed from shale oil by known methods for separating paraffins from petroleum. One method involves chilling shale oil to below its pour point to solidify the paraffinic fraction and then separating the solidified paraffinic fraction from the liquid components of the chilled oil with a coarse filter.

Another method of separating a paraffinic fraction involves contacting shale oil above its pour point, i.e., while the paraffin fraction is liquid, with solid, finely-divided urea. This is conveniently done by passing the shale oil through a packed column of urea. The solid urea selectively extracts n-paraffins, slightly branched paraffins with lower alkyl (1 or 2 carbon) side groups, and paraffinic compounds having terminal functional groups such as carboxylic acid, ester, thiol, and hydroxyl groups from the oil to form urea-paraffin adduct. The adduct or clathrate is separated from the oil and mixed with warm water, which dissolves the urea. The paraffinic fraction forms an oily layer on the water that solidifies upon cooling. Paraffinic fraction isolated with the use of urea comprises straight chain and slightly branched paraffins and end substituted paraffinic compounds having about 6 to 40 carbons. The urea can be recrystalized and reused. The use of urea for separating paraffinic fractions from petroleum is described in "Crystalline Adducts of Urea with Linear Aliphatic Compounds" by W. J. Zimmerschied et al, *Industrial and Engineering Chemistry* Vol. 42, pages 1300–1306 (July 1950), the disclosure of which is incorporated herein by this reference.

Retorting of oil shale in a fragmented permeable mass of particles containing oil shale in an in situ oil shale retort by advancement of a combustion zone therethrough produces shale oil having a characteristic kind and distribution of paraffinic constituents. During retorting of a particular retort, the paraffinic content of crude shale oil withdrawn from the retort can rise from below about 5 weight percent to above about 15 weight percent. When a fraction comprising such paraffinic constituents is separated from such crude shale oil the pour point of the shale oil is substantially lowered. When the separated fraction is reintroduced into the shale oil from which it was separated, the pour point of the oil returns to its original value. However, when paraffinic fraction is separated from such shale oil and an equal weight of a paraffinic fraction obtained by urea clathration from shale oil produced by above ground retorting in accordance with the TOSCO II process is added to the in situ shale oil from which the paraffinic fraction was separated, the pour point thereof increased slightly, but does not rise to its original value. It is clear, therefore, that the paraffinic constituents of shale oil produced in situ retorting are different from the paraffinic constituents of shale oil produced by such an above ground retorting process. The paraffinic content of shale oil from in situ retorts as described herein has a significant effect upon the pour point of such shale oil.

Figure 3:
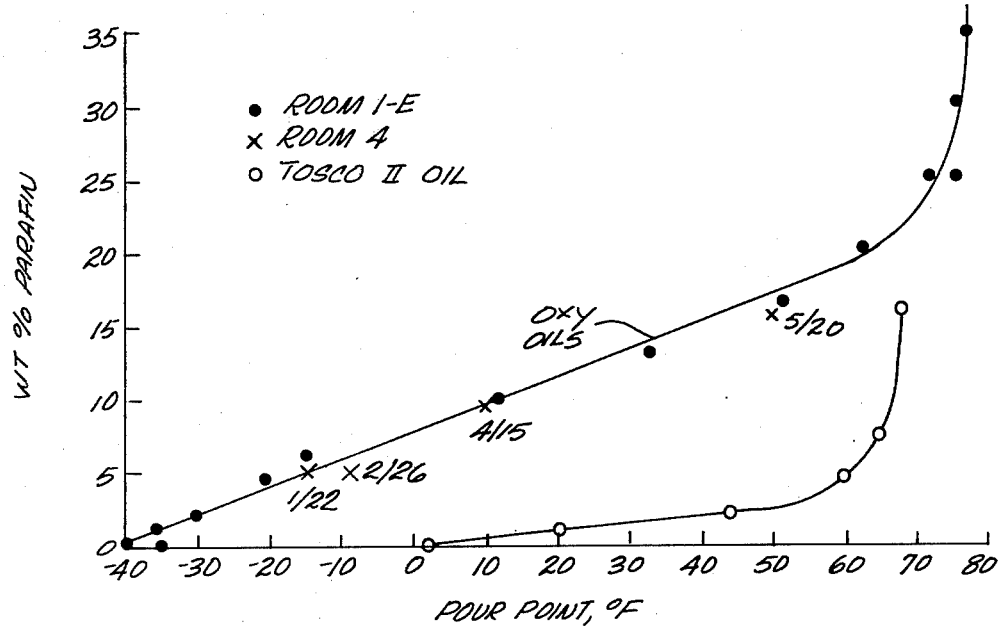
FIG. 3 is a graph of the pour points of shale oils from such an in situ oil shale retort and from an above ground retort vs the paraffin content of the oil.

FIG. 3 graphically depicts the relationship between the pour point of such shale oil and the paraffinic content thereof. The curve defined by the black dots are obtained by separating paraffins selectively from crude in situ shale oil by formation of a urea-paraffin clathrate. Known quantities of paraffin fraction were then blended back into the dewaxed oil and the pour point was measured after each addition. The poinds indicated by X's represent the measured pour points and n-paraffin contents of samples of crude shale oil withdrawn from the above mentioned Room 4 at various stages of its production life.

FIG. 3 also shows the relationship between pour point and paraffin content of shale oil produced by above ground retorting in accordance with the TOSCO II process which involves contacting crushed oil shale with hot ceramic balls for decomposing kerogen.

Lower paraffins, such as those having up to 14 carbon atoms per molecule can be liquid at temperatures below about 50° F., whereas higher paraffins can be solid at such temperatures. It is believed, without intent to be bound by the theory, that crystallization of such higher paraffinic compounds in shale oil at the pour point sets up a matrix or lattice that prevents the oil from flowing even though only a portion of the total shale oil has crystallized; that constituents of the low boiling fraction and such lower paraffins can act as solvents to lower the temperature at which the higher paraffins will crystallize, i.e., the pour point; and that constituents of the low boiling fraction and end-substituted or branched lower paraffins can act as crystal modifiers that prevent paraffin crystals from interlocking to form such a matrix.

The separated paraffinic fraction can therefore be further fractionated, for example, by distillation, to a lower paraffinic subfraction that is liquid at temperatures below about 50° F. and a higher paraffinic subfraction that is solid at such temperatures. It is believed that the relationship between the paraffinic content and the pour point of shale oil from in situ oil shale retorts as illustrated in FIG. 3 is attributable largely to the content of such a higher paraffinic subfraction in the oil.

In still another embodiment of the invention, the separated fraction can be a high boiling residual fraction constituting up to about 25 weight percent of the shale oil from which it is separated. Such high boiling fraction can be separated by distillation of shale oil, preferably under reduced pressure, to leave high boiling fraction as a residue. Such high boiling fraction can contain a substantial proportion of higher paraffinic constituents such as those present in the heavier paraffin subfraction described above. Thus, the separation of high boiling fraction from shale oil can result in a lowering of the pour point of the oil.

Some prior art processes for modifying the pour point of shale oil involve separaing the oil into fractions, chemically altering at least one of the fractions, and recombining the fractions; other involve separating a fraction from shale oil and chemically altering the fraction to produce a pour point modifier for addition to shale oil. See, for example, U.S. Pat. Nos. 3,106,521; 3,284,336; 3,523,071; 3,532,618; 3,700,585; and 3,738,931. In contrast to the prior art processes, in practice of this invention, a fraction is separated from shale oil, but no steps are taken to chemically alter the components of the fraction. That is, when a fraction is separated from shale oil in accordance with this invention, the chemical structures of components in the separated fraction and in the oil from which the fraction is separated remain substantially unchanged. Thus, the separated fraction and the oil from which it is separated can be recombined to produce crude shale oil having substantially the same composition and properties as the original crude shale oil before separation of the fraction. In still other words, in practice of this invention, a physical separation of some components of shale oil from other components of the shale oil is effected and the chemical structures of the components are preserved substantially intact. Although minor chemical changes can occur, particularly when distillation at temperatures much above 100° to 125° C. is employed, it is preferred to minimize or to avoid such chemical changes in effecting separation of the fraction. Because shale oil is a complex, chemically active mixture of components, minor chemical changes can be difficult to avoid entirely. The term "substantially chemically unchanged" is intended as used herein to allow for minor chemical changes that do not substantially affect the composition or properties of the oil or of the fraction to which the term is applied.

The pour point of the crude shale oil from which a low boiling fraction is separated can rise when the low boiling fraction is removed. It is preferable in such separations to start with a crude shale oil having a pour point lower than is necessary for convenient handling at the time low boiling fraction is removed. For example, in winter when a pour point no higher than about 20° F. is desired, crude shale oil having a pour point substantially lower than 20° F., e.g. below about 0° F., is used as the source of low boiling fraction. In summer, when a much higher pour point, e.g. about 60° F. or higher, is acceptable, crude shale oil having a pour point higher than 20° F., e.g. 30° to 40° F. can be used. The shale oil from which low boiling fraction is separated can still have a desirable pour point for convenient handling under prevailing conditions. The proportion of low boiling fraction removed can be limited to avoid an excessively high pour point in the resulting shale oil.

Paraffinic fraction or high boiling fraction can be separated from shale oil having a pour point that is too high for convenient handling at the time the fraction is separated, to produce a modified shale oil having a lower pour point than the shale oil from which the paraffinic fraction is separated. Paraffinic fraction or high boiling fraction that is separated can be blended with shale oil having a lower pour point than necessary for convenient handling at the time of blending to produce a blended shale oil. The proportion of high boiling fraction or paraffinic fraction in the blended shale oil can be regulated to provide a blended shale oil having a pour point low enough for pumping under prevailing conditions.

The fraction obtained from crude shale oil can be used immediately or stored for future use. For example, low boiling fraction obtained from crude shale oil withdrawn early in the retorting of an in situ oil shale retort can be blended into crude shale oil having a relatively higher pour point withdrawn late in the retorting period of the same retort or of another in situ oil shale retort. Low boiling fraction can be accumulated warm periods and then blended into crude shale oil produced during colder periods, when lower pour points are necessary for convenient handling. Paraffinic fraction or high boiling fraction can be accumulated during winter months and blended into shale oil during the warmer months when the rise in pour point caused by the addition of the paraffinic fraction or high boiling fraction will not be troublesome. Similarly, low boiling fraction obtained from crude shale oil in warmer regions can be shipped to colder regions for blending with crude shale oil produced there and vice versa as to paraffinic fraction or high boiling fraction.

Practice of this invention serves two purposes:

(1) to lower the pour point of shale oil produced by in situ retorting without the use of additives from outside sources and without chemically altering the composition of the oil, by adding or removing an appropriate fraction of the oil itself; and (2) to utilize fully a paraffinic fraction or high boiling fraction separated from shale oil. The first purpose is accomplished by separating a low boiling fraction from shale oil that has a low pour point without raising the pour point of the oil above acceptable limits for the prevailing temperature and blending such low boiling fraction with other shale oil to lower the pour point thereof, or be separating a paraffinic fraction or high boiling fraction from shale oil to lower the pour point thereof to within acceptable limits. The second purpose is accomplished by blending paraffinic fraction or high boiling fraction with shale oil having a lower than necessary pour point while keeping the pour point within acceptable limits for pumpability at prevailing temperatures. Thus, the need for separate shipping of paraffinic fraction or high boiling fraction is avoided. Also, the use of low boiling fraction to lower the pour point of crude shale oil can avoid the need for dewaxing such oil.

The proportion of low boiling fraction separated from or blended into crude shale oil depends upon the difference between the actual pour point of the oil and the pour point desired in view of prevailing temperatures, and on the proportion of the low boiling fraction in the oil, and thus can vary widely.

The proportion of paraffinic fraction or high boiling fraction to be removed from or added to shale oil likewise depends upon the difference between the actual pour point of the oil and the desired pour point and upon the paraffinic content of the oil. By referring to FIG. 3, and measuring the paraffinic content of the oil, one can readily determine how much paraffinic fraction to remove or add in order to obtain shale oil having the desired pour point.

A blended shale oil of the present invention can comprise shale oil, such as crude shale oil, and any proportion of added low boiling fraction of shale oil effective to lower the pour point of the shale oil. For example, blended shale oil can comprise up to about 30 weight percent of low boiling fraction, the balance being crude shale oil. Often, about 5 to 10 weight percent of added low boiling fraction can be sufficient to lower the pour point to an acceptable level.

A blended shale oil of the present invention can comprise shale oil, such as crude shale oil, and any minor proportion of added paraffinic fraction of shale oil or high boiling fraction of shale oil effective to raise the pour point of the shale oil in the blend, the blended shale oil remaining pumpable at prevailing temperatures. Such a blended shale oil can comprise, e.g. up to about 15 weight percent or more of added paraffinic fraction or high boiling fraction, the balance being crude shale oil.

As the terms are used herein, a "blended shale oil" or "blended shale oil composition" comprises crude shale oil and an added minor proportion of a fraction separated from crude shale oil. A "modified shale oil" is the portion remaining of a crude shale oil from which a fraction has been separated in accordance with this invention. A "paraffinic fraction" is a predominantly n-paraffinic fraction, such as the fraction that can be separated from crude shale oil with solid urea.

Although the present invention has been described in terms of particular details and embodiments thereof, the particulars of the description are not intended to limit the invention, the scope of which is defined in the following claims:

What is claimed is:

1. A method for processing shale oil produced in an in situ oil shale retort in a subterranean formation containing oil shale comprising the steps of:

producing crude shale oil by in situ retorting of oil shale in a subterranean in situ oil shale retort containing a fragmented permeable mass of particles containing oil shale by advancing a combustion zone through the fragmented mass by introducing an oxygen containing gas into the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including crude shale oil;

withdrawing a first portion of crude shale oil from such an in situ oil shale retort;

withdrawing a second portion of crude shale oil from such an in situ oil shale retort;

separating a fraction from such first portion of crude shale oil, the separated fraction being substantially chemically unchanged by the separation; and blending a sufficient proportion of such separated fraction with the second portion of crude shale oil to produce a blended shale oil composition having a pour point different from the pour point of the second portion of crude shale oil.

2. A method as recited in claim 1 in which the fraction is a low boiling fraction, the low boiling fraction being a distillation cut of such first portion of crude shale oil comprising up to about 25 weight percent of the first portion of crude shale oil, and the pour point of the blended shale oil composition is lower than the pour point of the second portion of crude shale oil.

3. A method as recited in claim 2 in which the blended shale oil composition comprises such low boiling fraction in a proportion of up to about 10 percent by weight of blended shale oil composition.

4. A method as recited in claim 2 in which the low boiling fraction has a boiling range up to about 500° F. at one atmosphere pressure.

5. A method as recited in claim 1 in which the fraction is a paraffinic fraction obtained by treating such first portion of crude shale oil to separate from about 1 to 15 weight percent of the first portion of crude shale oil as said paraffinic fraction, said paraffinic fraction being solid at temperatures below about 80° F., and the pour point of the blended shale oil composition is higher than the pour point of the second portion of crude shale oil.

6. A method as recited in claim 5 in which such paraffinic fraction comprises n-paraffins having from about 6 to about 40 carbon atoms per molecule.

7. A method as recited in claim 5 in which the blended shale oil composition comprises such paraffinic fraction in a proportion of up to about 15 percent by weight of blended shale oil composition.

8. A method as recited in claim 1 in which the fraction is a high boiling fraction obtained by distilling such first portion of crude shale oil to leave a residue of up to about 25 weight percent of the first portion of crude shale oil as said high boiling fraction, and the pour point of the blended shale oil composition is higher than the pour point of the second portion of crude shale oil.

9. A method as recited in claim 8 in which the blended shale oil composition comprises such high boiling fraction in a proportion of up to about 15 percent by weight of blended shale oil composition.

10. A method for lowering the pour point of shale oil produced by in situ retorting which comprises:

separating a low boiling fraction from a first portion of shale oil produced by in situ retorting to produce a modified shale oil having a higher pour point than the pour point of the first portion of shale oil; and blending a sufficient proportion of such low boiling fraction with a second portion of shale oil produced by in situ retorting to produce a blended shale oil composition having a pour point lower than the pour point of the second portion of shale oil.

11. A method as recited in claim 10 in which the second portion of shale oil is crude shale oil having a pour point higher than about 30° F. and the pour point of the blended shale oil is below about 20° F.

12. A method as recited in claim 10 in which such low boiling fraction is a distillation cut of crude shale oil comprising up to about 25 weight percent of such crude shale oil.

13. A method as recited in claim 10 in which the low boiling fraction has a boiling range up to about 500° F. at one atmosphere pressure.

14. A method as recited in claim 10 in which the blended shale oil composition comprises such low boiling fraction in a proportion of up to about 10 percent by weight of blended shale oil composition.

15. A method for lowering the pour point of shale oil produced by in situ retorting which comprises:

separating a paraffinic fraction from a first portion of shale oil produced by in situ retorting to produce a modified shale oil having a pour point lower than the pour point of the first portion of shale oil; and blending a sufficient proportion of such paraffinic fraction with a second portion of shale oil produced by in situ retorting to produce a blended shale oil composition having a pour point higher than the pour point of the second portion of shale oil.

16. A method as recited in claim 15 in which such paraffinic fraction is obtained by treating shale oil to separate up to about 15 weight percent of the shale oil as said paraffinic fraction, said paraffinic fraction being solid at temperatures below about 80° F.

17. A method as recited in claim 15 which further comprises separating said paraffinic fraction into a lower paraffinic subfraction that is liquid at temperatures below about 50° F. and a higher paraffinic subfraction that is solid at temperatures below about 50° F., and blending such higher paraffinic subfraction with said second portion of shale oil to produce said blended shale oil composition.

18. A method as recited in claim 15 in which the blended shale oil composition comprises such paraffinic fraction in a proportion of up to about 15 percent by weight of blended shale oil composition.

19. A method for lowering the pour point of shale oil produced by in situ retorting which comprises:

separating a high boiling fraction from a first portion of shale oil produced by in situ retorting to produce a modified shale oil having a pour point lower than the pour point of the first portion of shale oil; and blending a sufficient proportion of such high boiling fraction with a second portion of shale oil produced by in situ retorting to produce a blended shale oil composition having a pour point higher than the pour point of the second portion of shale oil.

20. A method as recited in claim 19 in which such high boiling fraction is obtained by distilling shale oil to leave a residue comprising up to about 25 weight percent of said shale oil as said high boiling fraction, said high boiling fraction being substantially chemically unchanged by the distillation.

21. A method as recited in claim 19 in which the blended shale oil composition comprises such high boiling fraction in a proportion of up to about 15 percent by weight of blended shale oil composition.

22. A method for processing oil shale produced in an in situ oil shale retort having a fragmented permeable mass of formation particles containing oil shale in a subterranean formation containing oil shale comprising the steps of:

advancing a combustion zone through the fragmented mass by introducing an oxygen containing gas into the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including crude shale oil;

withdrawing a first portion of crude shale oil from said fragmented mass during an earlier interval of retorting of said fragmented mass;

withdrawing a second portion of crude shale oil from said fragmented mass during a later interval of retorting of said fragmented mass, the second portion of crude shale oil having a pour point higher than the pour point of the first portion of crude shale oil;

distilling a low boiling fraction from the first portion of crude shale oil; and blending a sufficient proportion of such low boiling fraction with the second portion of crude shale oil to produce a blended shale oil having a lower pour point than the pour point of the second portion of crude shale oil.

23. A method as recited in claim 22 in which the low boiling fraction is a distillation cut of the first portion of crude shale oil comprising up to about 25 weight percent of the first portion of crude shale oil.

24. A method as recited in claim 22 in which the blended shale oil composition comprises such low boiling fraction in a proportion of up to about 10 percent by weight of blended shale oil composition.

25. A method for lowering the pour point of crude shale oil produced by in situ retorting which comprises the steps of:

distilling a low boiling fraction from shale oil produced by in situ retorting, the low boiling fraction having a boiling range of up to about 500° F. at one atmosphere; and blending a sufficient proportion of such low boiling fraction with crude shale oil produced by in situ retorting to produce a blended shale oil having a pour point lower than the pour point of the crude shale oil.

26. A method for processing shale oil produced in an in situ oil shale retort having a fragmented permeable mass of formation particles containing oil shale in a subterranean formation containing oil shale comprising the steps of:

advancing a combustion zone through the fragmented mass by introducing an oxygen containing gas into the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including crude shale oil;

withdrawing a first portion of crude shale oil from said fragmented mass during one interval of retorting of said fragmented mass;

withdrawing a second portion of crude shale oil from said fragmented mass during another interval of retorting of said fragmented mass, the second portion of crude shale oil having a higher pour point than the pour point of the first portion of crude shale oil;

separating a paraffinic fraction from the second portion of crude shale oil to produce a modified shale oil having a pour point lower than the pour point of the second portion of crude shale oil; and blending a sufficient proportion of such paraffinic fraction with the first portion of crude shale oil to produce a blended shale oil composition having a pour point higher than the pour point of the first portion of crude shale oil.

27. A method as recited in claim 26 in which the separated paraffinic fraction is solid at temperatures below about 80° F.

28. A blended shale oil composition comprising a major proportion of crude shale oil produced by in situ retorting and an added minor proportion of a low boiling fraction of crude shale oil produced by in situ retorting, the blended shale oil composition having a pour point lower than the pour point of said major proportion of crude shale oil.

29. A blended shale oil composition as recited in claim 28 in which the low boiling fraction is a distillation cut of crude shale oil comprising up to about 25 weight percent of such crude shale oil.

30. A blended shale oil composition as recited in claim 28 in which the low boiling fraction boils over a range of up to about 500° F. at one atmosphere pressure.

31. A blended shale oil composition as recited in claim 28 which comprises up to about 10 percent of such low boiling fraction by weight of blended shale oil composition.

32. A blended shale oil composition comprising a major proportion of crude shale oil produced by in situ retorting and an added minor proportion of a paraffinic fraction of crude shale oil produced by in situ retorting, the blended shale oil composition having a pour point higher than the pour point of said major proportion of crude shale oil.

33. A blended shale oil composition as recited in claim 32 in which the added paraffinic fraction is solid at temperatures below about 80° F.

34. A blended shale oil composition as recited in claim 32 which comprises such added paraffinic fraction in a proportion up to about 15 percent by weight of blended shale oil composition.

35. A blended shale oil composition comprising a major proportion of crude shale oil produced by in situ retorting and minor proportion of a high boiling fraction of crude shale oil produced by in situ retorting, the blended shale oil composition having a pour point higher than the pour point of said major proportion of crude shale oil.

36. A blended shale oil composition as recited in claim 35 in which such high boiling fraction is obtained by distilling a portion of crude shale oil to leave a residue comprising up to about 25 weight percent of the portion of crude shale oil being distilled, the high boiling fraction being substantially chemically unchanged by the distillation.

37. A blended shale oil composition as recited in claim 35 comprising such high boiling fraction in a proportion of up to about 15 percent by weight of blended shale oil composition.

38. A method of controlling the pour point of a crude shale oil produced by in situ retorting of oil shale which comprises controlling the proportion of n-paraffins having between about 6 and 40 carbon atoms per molecule in such crude shale oil in the range of about 5 to 10 weight percent.

39. A method as recited in claim 38 which comprises separating an n-paraffin fraction from the crude shale oil produced by in situ retorting by contacting the crude shale oil with solid urea to form a urea-paraffin adduct, and separating the urea-paraffin adduct from the oil.

40. A method of controlling the pour point of a crude shale oil produced by in situ retorting of oil shale which comprises controlling the proportion of n-paraffins having between about 6 and 40 carbon atoms per molecule in the range of about 5 to 10 weight percent in such crude shale oil by adding n-parraffin fraction to the crude shale oil, said n-paraffin fraction having been separated from crude shale oil by contacting the crude shale oil with solid urea to form a urea-paraffin adduct, separating the urea-paraffin adduct from the shale oil, and recovering an n-paraffin fraction from the urea.

* * * * *

UNITED STATES PATENT AND TRADEMARK OFFICE

CERTIFICATE OF CORRECTION

PATENT NO. : 4,181,177

DATED : January 1, 1980

INVENTOR(S) : Leslie E. Compton

It is certified that error appears in the above-identified patent and that said Letters Patent are hereby corrected as shown below:

Column 7, line 13, -- fragmented mass. The fragmented mass also has a substantial -- should be inserted after "in the" and before "surface";

Column 7, line 57, -- the -- should be inserted after "of" and before "retort";

Column 7, line 67, "and" should be -- the --.

Column 9, line 24, --percent-- should be inserted after "weight" and before "of";

Column 9, line 32, "distillatin" should be -- distillation --.

Column 10, line 61, "increased" should be -- increases --;

Column 10, line 64, -- by -- should be inserted after "produced" and before "in".

Column 11, line 8, "poinds" should be -- points --;

Column 11, line 23, "compounds" should be -- components --;

Column 11, line 55, "separaing" should be -- separating --;

Column 11, line 57, "other" should be --others --.

Column 12, line 12, -- about -- should be inserted after "above" and before "100°";

Column 12, line 61, -- during -- should be inserted after "accumulated" and before "warm".

Column 13, line 18, "be" should be -- by --.

Signed and Sealed this

*Twenty-fifth* Day of *March 1980*

[SEAL]

*Attest:*

SIDNEY A. DIAMOND

*Attesting Officer*

*Commissioner of Patents and Trademarks*